US009391411B2

(12) United States Patent
Tanigawa

(10) Patent No.: US 9,391,411 B2
(45) Date of Patent: Jul. 12, 2016

(54) CONNECTOR MOUNTING STRUCTURE

(71) Applicant: Sumitomo Wiring Systems, Ltd., Yokkaichi, Mie (JP)

(72) Inventor: Norihiko Tanigawa, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/745,575

(22) Filed: Jun. 22, 2015

(65) Prior Publication Data

US 2015/0380881 A1 Dec. 31, 2015

(30) Foreign Application Priority Data

Jun. 30, 2014 (JP) ..... 2014-134740

(51) Int. Cl.
*H01R 13/74* (2006.01)
*H01R 13/631* (2006.01)

(52) U.S. Cl.
CPC ..... *H01R 13/743* (2013.01); *H01R 13/6315* (2013.01)

(58) Field of Classification Search
CPC ..... H01R 13/743; H01R 13/74; H01R 13/745
See application file for complete search history.

(56) References Cited

U.S. PATENT DOCUMENTS 4,407,042 A * 10/1983 Schramme ..... H02B 1/044 16/2.1
5,779,500 A * 7/1998 Tokuwa ..... H01R 13/743 439/544
6,089,909 A * 7/2000 Tokuwa ..... H01R 13/743 439/552
6,767,239 B2 7/2004 Fukamachi
7,318,748 B2 * 1/2008 Yamakado ..... H01R 13/743 439/552

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A connector mounting structure includes a first device (60) with a first mounting hole (61) and a first connector (F) to be mounted in the first mounting hole (61). First resilient lock pieces (12) are formed on the first connector (F) and are deflected by interfering with an edge of the first mounting hole (61) in the process of mounting the first connector (F) into the mounting hole (61). First locking projections (14) are formed on the first connector (F) and sandwich the edge of the first mounting hole (61) between the first resilient lock pieces (12) and the first locking projections (14). Second deflection regulating portions (49) are formed on a second connector (M) and regulate separation of the first resilient lock pieces (12) from the edge of the first mounting hole (61) with the second connector (M) connected to the first connector (F).

3 Claims, 18 Drawing Sheets

CONNECTOR MOUNTING STRUCTURE

BACKGROUND

1. Field of the Invention

The invention relates to a connector mounting structure.

2. Description of the Related Art

U.S. Pat. No. 6,767,239 discloses a structure for mounting a connector into a mounting hole of a panel. A resilient lock piece and a locking projection to be locked to an edge of the mounting hole are formed on the outer surface of the connector, and the connector is locked on the panel by sandwiching the panel between the resilient lock piece and the locking projection.

The resilient lock piece is exposed on the outer surface of the connector and may be deflected in a direction to separate from the edge of the mounting hole if external matter interferes with the resilient lock piece. The connector will detach from the panel if the resilient lock piece is separated from the edge of the mounting hole.

The invention was completed based on the above situation and aims to reliably mount a connector reliably into a mounting hole of a device.

SUMMARY OF THE INVENTION

The invention includes a device formed with a mounting hole and a device-side connector that is to be mounted in the mounting hole. A resilient lock piece is formed on an outer surface of the device-side connector and is configured to be deflected resiliently by interfering with an edge of the mounting hole in the process of mounting the device-side connector into the mounting hole. A locking projection is formed on the outer surface of the device-side connector and is configured to hold the device-side connector in the mounting hole by sandwiching the edge part of the mounting hole between the resilient lock piece and the locking projection. A mating connector is connectable to the device-side connector. A deflection regulating portion is formed on the mating connector and is configured to regulate resilient deflection of the resilient lock piece in a direction separating from the edge of the mounting hole when the mating connector is connected to the device-side connector.

According to this configuration, the deflection regulating portion keeps the edge of the hole sandwiched between the resilient lock piece and the locking projection when the device-side connector and the mating connector are connected. In this way, the device-side connector is reliably mounted in the mounting hole of the device.

The device-side connector may include a peripheral wall formed with the resilient lock piece and a block-like device-side housing accommodated in the peripheral wall. The mating connector may include a receptacle to be accommodated between an inner surface of the peripheral wall and an outer surface of the device-side housing, and the receptacle may function as the deflection regulating portion. Accordingly, the receptacle additionally functions as the deflection regulating portion. Thus, the shape of the mating connector can be simplified as compared with the case where a dedicated deflection regulating portion is formed separately from the receptacle.

The device-side connector may include a receptacle formed with the resilient lock piece, and the mating connector may include a mating housing surrounded by a peripheral wall and to be accommodated in the receptacle. An outer surface of the mating housing may function as the deflection regulating portion. The outer surface of the mating housing additionally functions as the deflection regulating portion. Thus, the shape of the mating connector can be simplified as compared with the case where a dedicated deflection regulating portion is formed separately from the mating housing.

DETAILED DESCRIPTION

Figure 1:
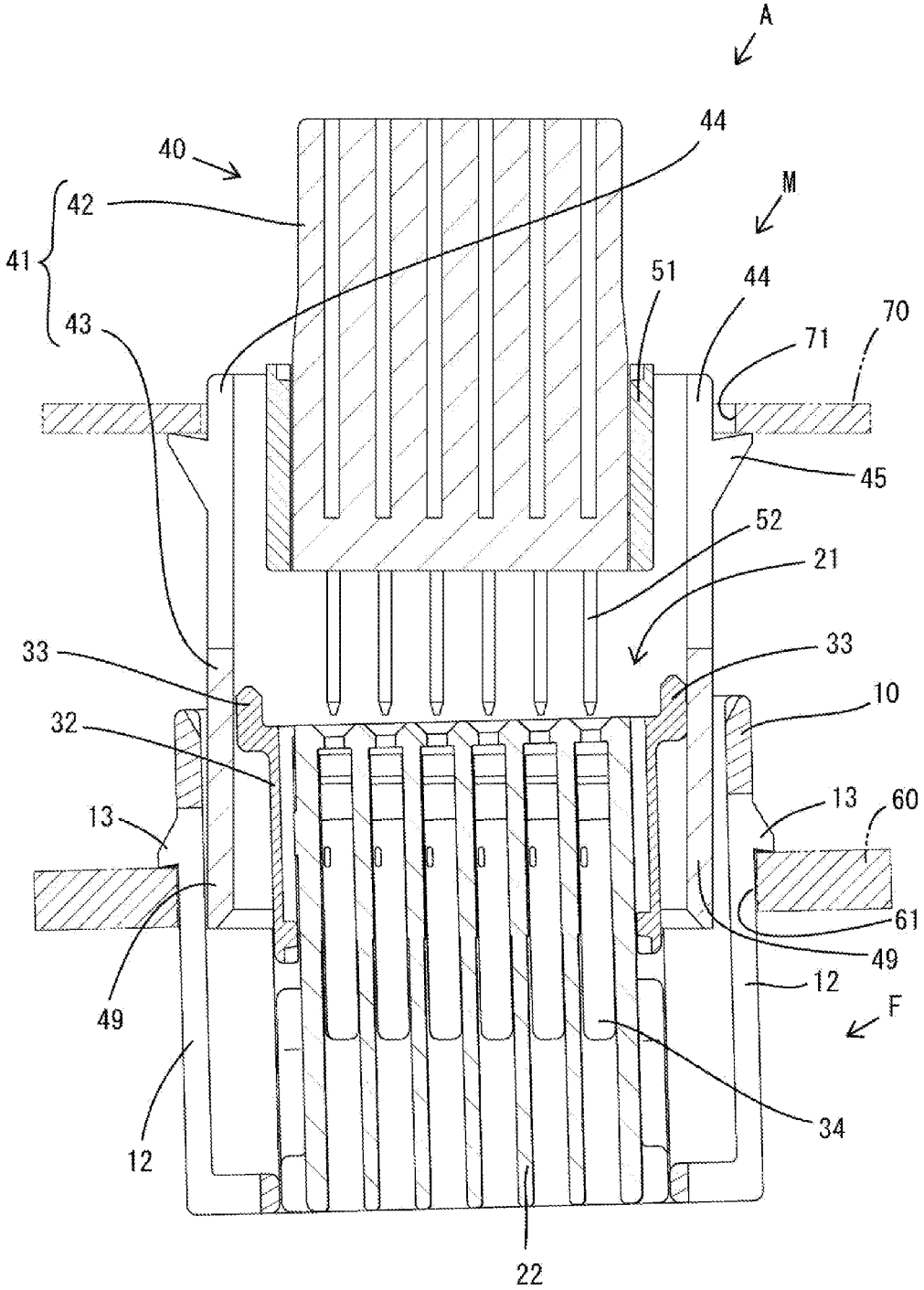
FIG. 1 is a section showing the process of assembling devices and connecting connectors in one embodiment.
Figure 2:
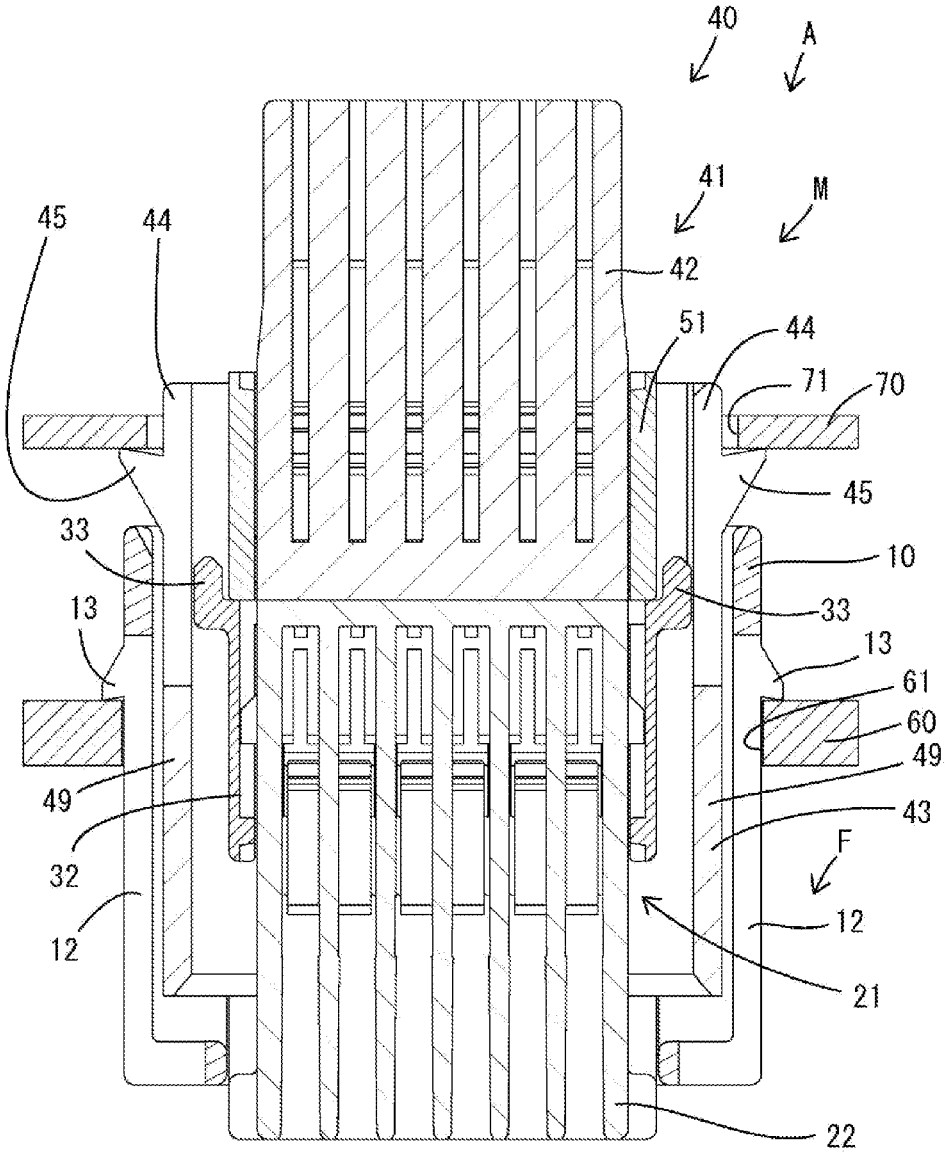
FIG. 2 is a section showing a state where the assembling of the devices and the connection of the connectors is completed.
Figure 3:
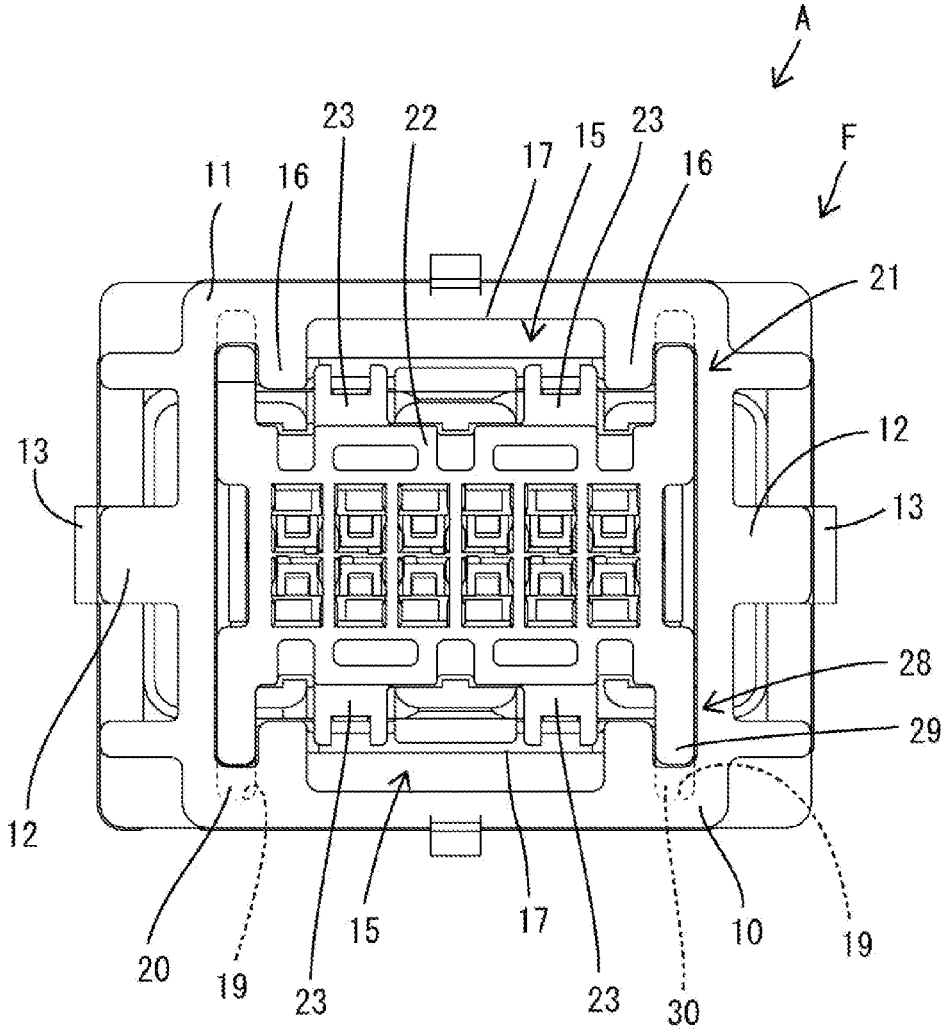
FIG. 3 is a bottom view showing a first connector and a second connector connected.

A connector in accordance with an embodiment of the invention is identified by the letter A in FIGS. 1-3 and includes a first connector F on a first device 60 and a second connector M on a second device 70. The first device 60 is provided fixedly, such as on a seat back of a seat of an automotive vehicle. As shown in FIGS. 1 and 2, a first mounting hole 61 vertically penetrates an upper part of the first device 60. The second device 70 is assembled with the first device 60 by being brought closer from above, such as on a head rest of an automotive vehicle. A second mounting hole 71 vertically penetrates the second device 70. The first connector F and the second connector M are connected when the second device 70 is assembled with the first device 60.

As shown in FIGS. 1 and 2, the first connector F is mounted on the first device 60 so that a surface facing the second connector M faces up. The first connector F includes a holder 10 made of synthetic resin, a first housing 21 made of synthetic resin and a plurality of female first terminal fittings 34 mounted in the first housing 21. The first housing 21 is relatively movable in a vertical direction with respect to the holder 10.

Figure 4:
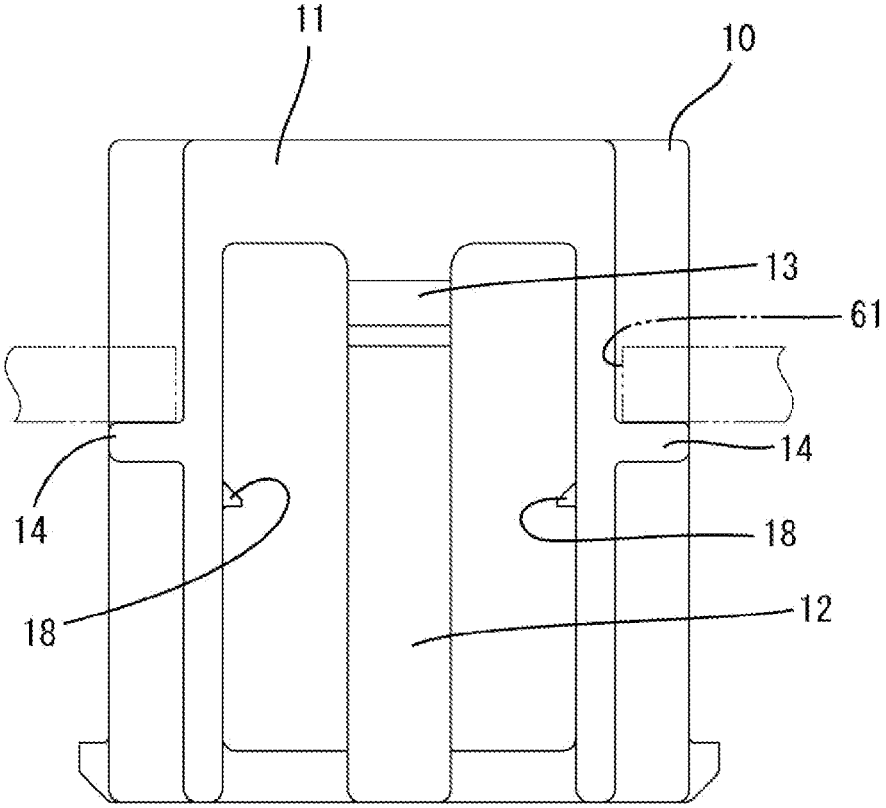
FIG. 4 is a side view of a holder.
Figure 5:
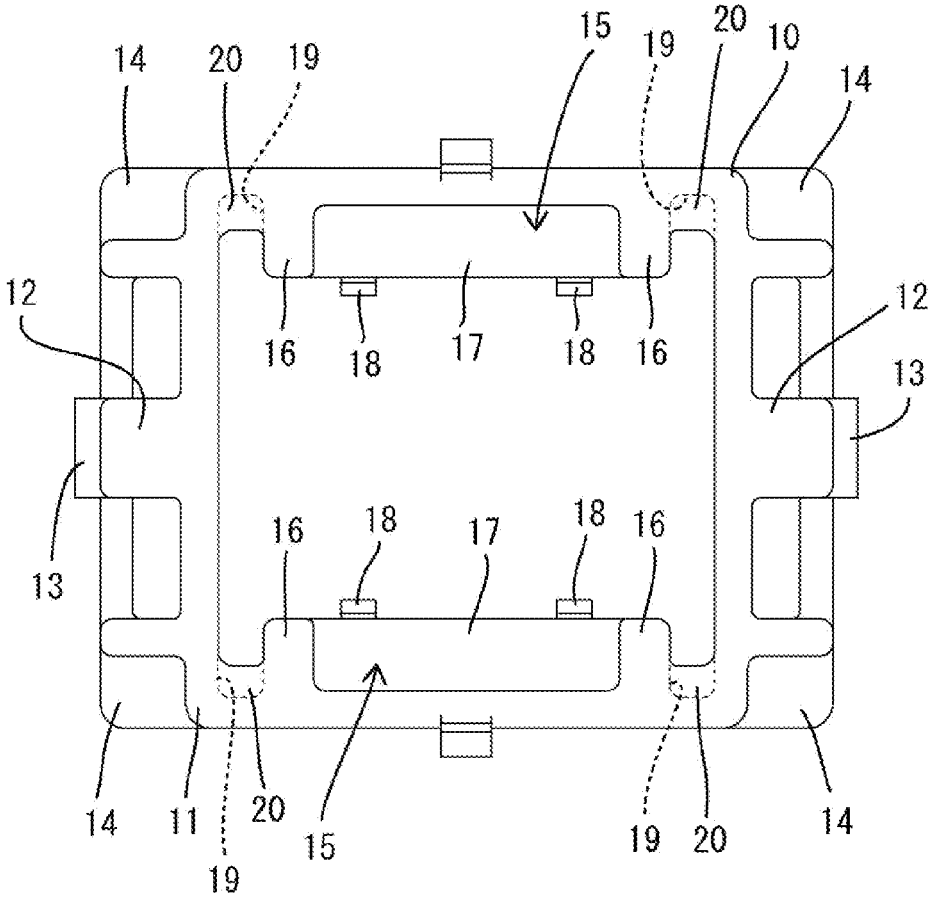
FIG. 5 is a bottom view of the holder.

As shown in FIGS. 4 and 5, the holder 10 includes a substantially rectangular tubular peripheral wall 11 with open upper and lower ends. The peripheral wall 11 includes a front panel, a rear panel and opposite left and right side panels. Each of the left and right side panels is formed with front and rear slits that are long and narrow in the vertical direction. Areas of the left and right side panels between the slits define first resilient lock pieces 12 that are long and narrow in the vertical direction and are supported on the front and rear panels at opposite upper and lower ends. A first lock projection 13 projects out on an upper part of the first resilient lock piece 12.

Four first locking projections 14 are formed on the outer surface of the peripheral wall 11 at positions slightly below the first lock projections 13 and at front and rear sides of each first resilient lock piece 12. With the first connector F mounted on the first device 60, the first lock projections 13 of the first resilient lock pieces 12 are locked to an edge of the first mounting hole 61 from above, as shown in FIG. 1, and the first locking projections 14 are locked to the edge of the first mounting hole 61 from below, as shown in FIG. 4. Thus, the edge of the first mounting hole 61 is sandwiched vertically by the first lock projections 13 of the first resilient lock pieces 12 and the first locking projections 14 to mount the first connector F (holder 10) on the first device 60 with vertical movements regulated or limited.

Figure 7:
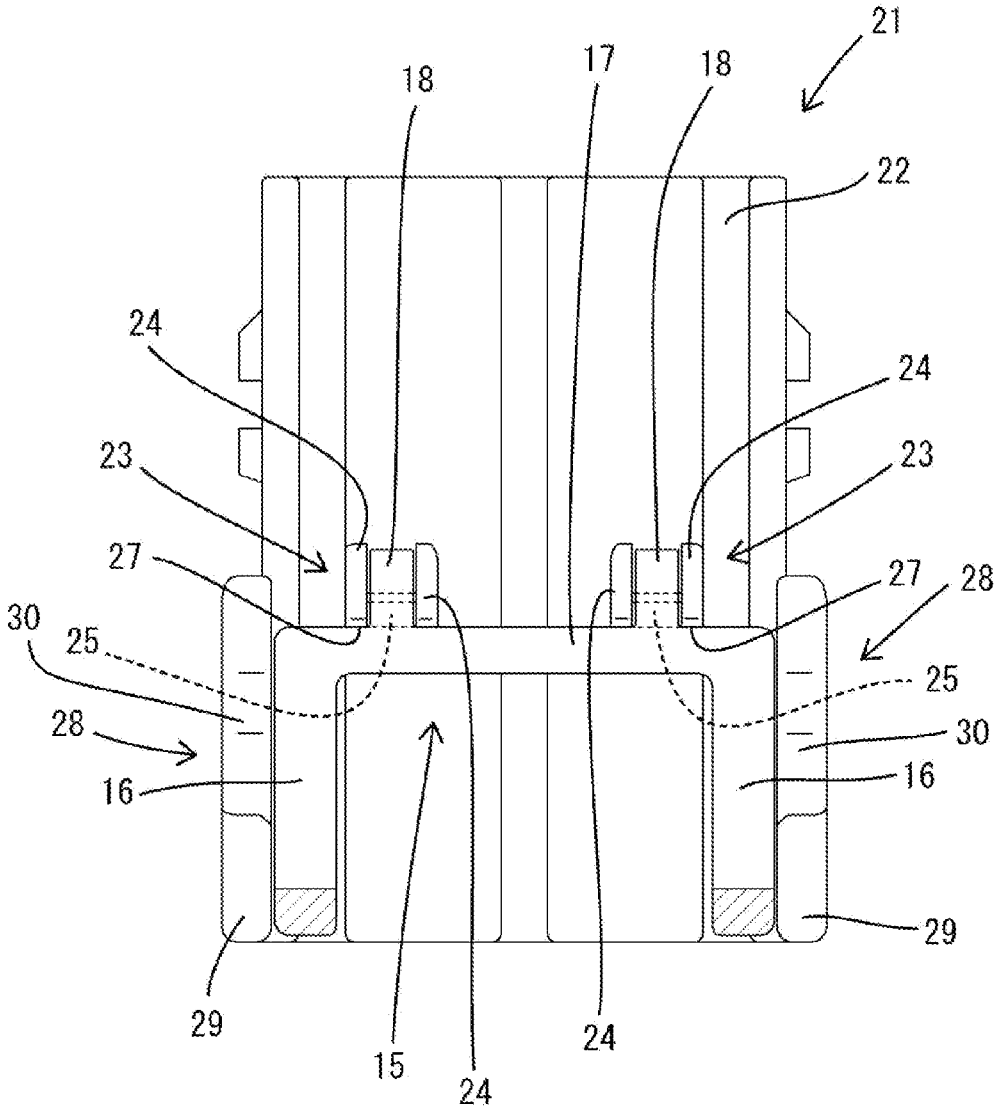
FIG. 7 is a front view showing a state where a resilient locking piece is locked in the first terminal holding member.

As shown in FIG. 5, front and rear symmetrical resilient locking pieces 15 are formed in the peripheral wall 11. Each resilient locking piece 15 is supported bilaterally symmetrically on the front or rear panel of the peripheral wall 11. As shown in FIG. 7, each resilient locking piece 15 includes left and right arms 16 connected to the inner surface of the front or rear panel and extending up along the front or rear panel. Upper extending ends of the arms 16 are coupled by a coupling 17 that is long and narrow in a lateral direction. As shown in FIGS. 5 and 7, each coupling 17 has left and right locking claws 18. The resilient locking piece 15 is resiliently deflectable forward and backward with lower ends of the arms 16 as supports.

As shown in FIG. 5, long narrow front and rear guide grooves 19 are formed in opposite left and right regions of the front and rear panels of the peripheral wall 11. Upper ends of the guide grooves 19 are open at the upper end of the peripheral wall 11 (holder 10) to face the second connector M. The guide grooves 19 guide the first housing 21 when the first housing 21 is moved vertically with respect to the holder 10. Lower ends of the guide grooves 19 are closed by stoppers 20 that have upper surfaces aligned oblique to the vertical direction (see FIGS. 14, 17 and 18).

The first housing 21 includes a first terminal holding member 22 for accommodating the first terminal fittings 34 and a first retainer 32 mounted on an upper end of the first terminal holding member 22 to retain the first terminal fittings 34. Opposite left and right outer surfaces of an upper end of the first retainer 32 define first deflection regulating portions 33. The first deflection regulating portions 33 function to regulate resilient deflection of second resilient lock pieces 44 in directions separating from a edge of the second mounting hole 71.

Figure 6:
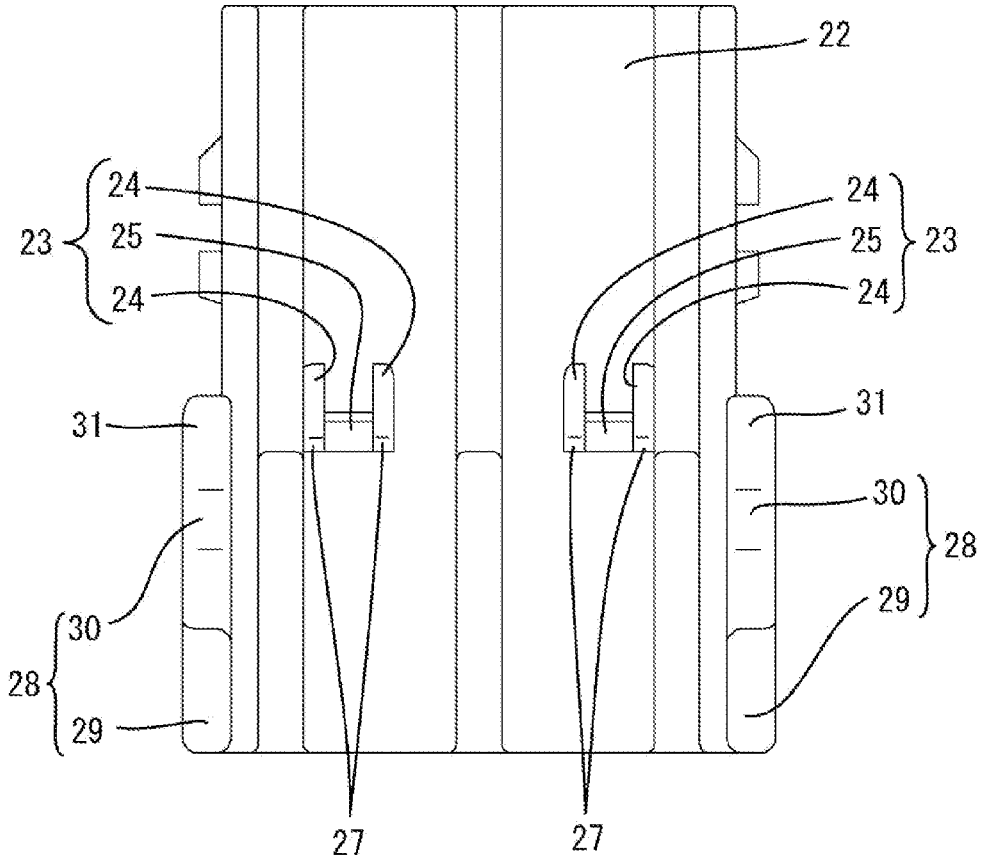
FIG. 6 is a front view of a first terminal holding member constituting a first housing.
Figure 8:
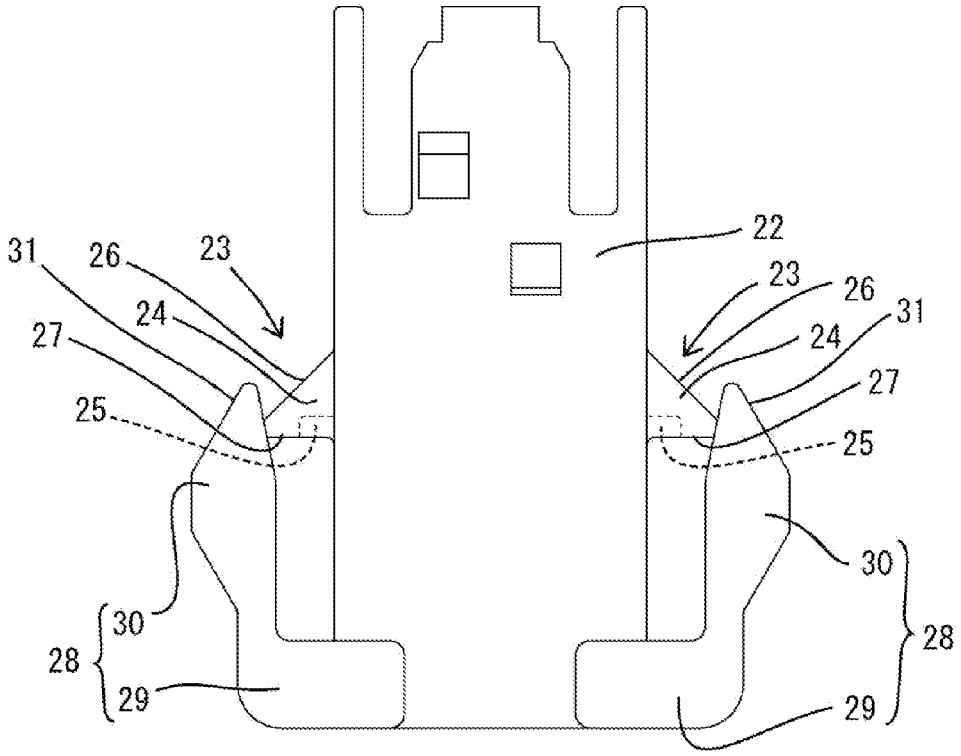
FIG. 8 is a side view of the first terminal holding member.

The first terminal holding member 22 has two pairs of symmetrical front and rear locks 23. As shown in FIG. 6, the locks 23 are arranged substantially on a vertical central part of the first terminal holding member 22. Each lock 23 has two plate-like and bilaterally symmetrical holding projections 24 projecting from the front or rear surface of the first terminal holding member 22 and a receiving projection 25 between the holding projections 24. As shown in FIG. 8, the holding projection 24 has a substantially right triangular shape in a side view. A guide edge 26 is defined at the top of the holding projection 24 and is oblique to the vertical direction. A horizontal locking edge 27 is defined at the bottom of the holding projection 24.

Figure 9:
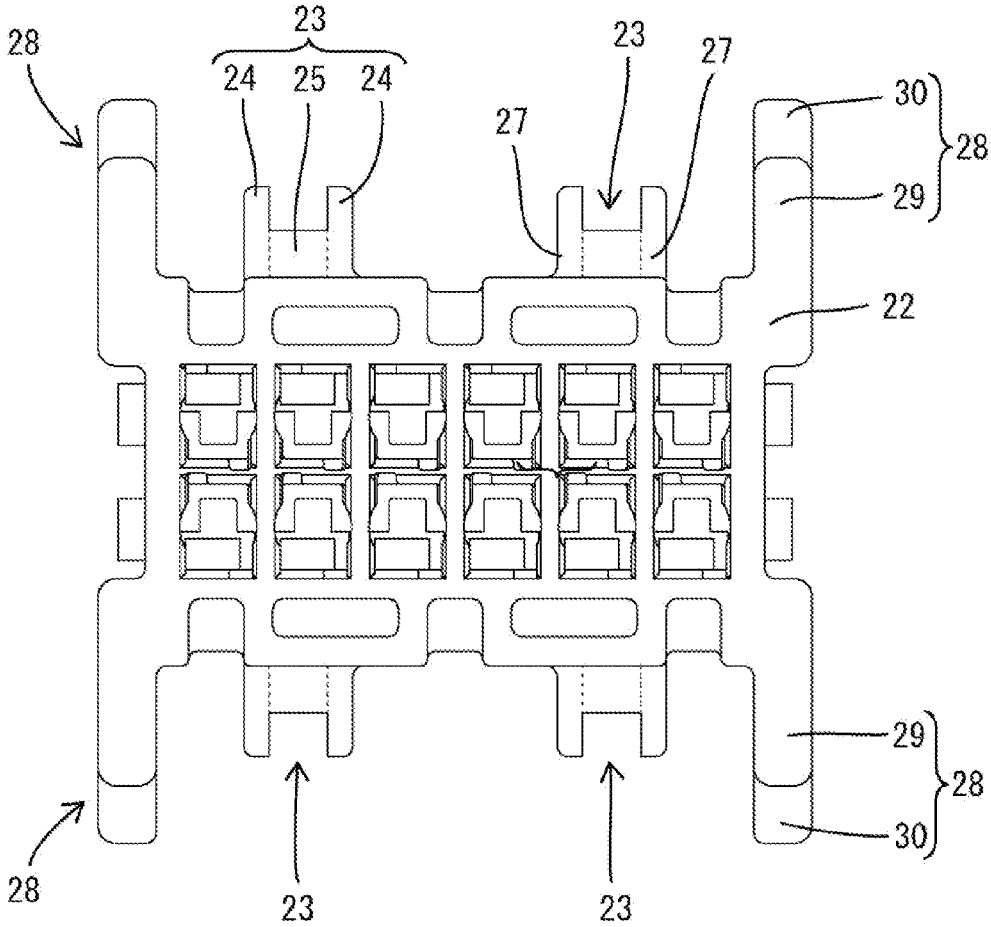
FIG. 9 is a bottom view of the first terminal holding member.

As shown in FIG. 9, the first terminal holding member 22 (first housing 21) is formed with two pairs of symmetrical front and rear resilient contact pieces 28. The resilient contact pieces 28 are arranged on opposite left and right sides of the front and rear surfaces of the first terminal holding member 22. As shown in FIG. 8, the resilient contact piece 28 on the front surface has a base 29 projecting forward from a lower part of the first terminal holding member 22 and a contact portion 30 cantilevered up from a front end projecting end of the base 29. The resilient contact piece 28 on the rear surface has a base 29 projecting back from the lower end of the first terminal holding member 22 and a contact portion 30 cantilevered up from a rear projecting end part of the base 29.

As shown in FIG. 9, the resilient contact piece 28 on the front surface projects farther forward than the front surface of the first terminal holding member 22. The contact portion 30 of the resilient contact piece 28 on the front surface projects farther forward than the base 29 and an upper end of a front of the contact portion 30 defines a guide 31 aligned oblique to the vertical direction, as shown in FIG. 8. Similarly, the resilient contact piece 28 on the rear surface projects farther back than the rear surface of the first terminal holding member 22, as shown in FIG. 9. The contact portion 30 on the rear surface projects farther back than the base 29 and an upper part of a rear edge of this contact portion 30 defines a guide 31 aligned oblique to the vertical direction as shown in FIG. 8.

A long wire (not shown) is connected to a lower part of each first terminal fitting 34 and drawn out downward of the first housing 21. Accordingly, in assembling the first housing 21 with the holder 10, the first housing 21 is accommodated into the peripheral wall 11 from below the holder 10 (from a side opposite to a side connected to the second housing 40) so that the wires do not obstruct the assembling operation. In the process of assembling the first housing 21 into the peripheral wall 11, the guides 31 of the resilient contact pieces 28 interfere with the stoppers 20, so that the resilient contact pieces 28 deflect resiliently toward the front or rear surface of the first housing 21 with the bases 29 as supports.

Figure 14:
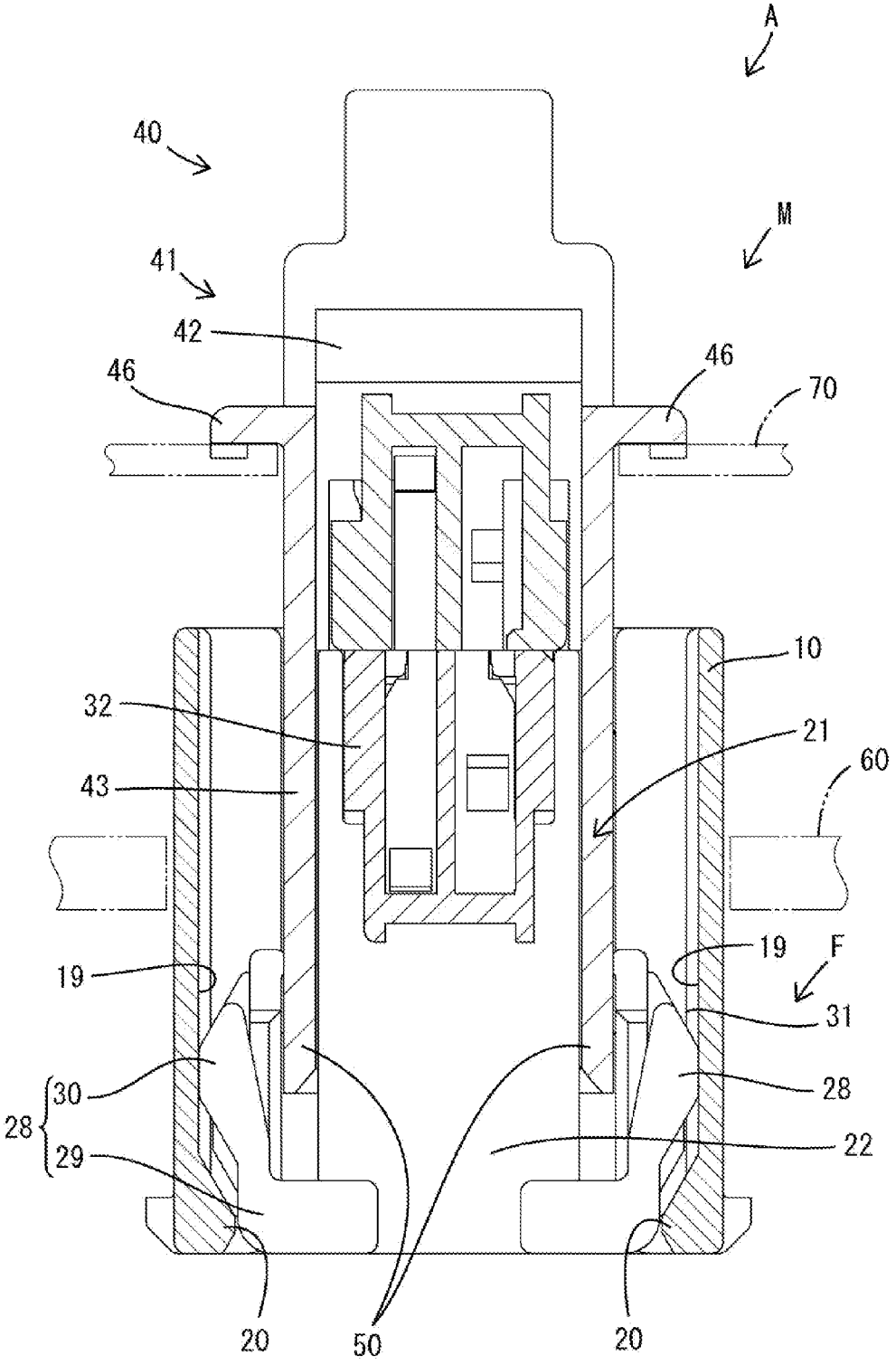
FIG. 14 is a side view in section showing a state where the first and second housings are connected properly.

The resilient contact pieces 28 resiliently return when the contact portions 30 pass over the stoppers 20 and the contact portions 30 are fit into the guide grooves 19 (see FIG. 14). Thereafter, the contact portions 30 slide in contact with the inner surfaces of the guide grooves 19, as the first housing 21 is assembled. This sliding contact positions the first housing 21 with respect to the holder 10 in a front-back direction and a lateral direction and regulates relative movements in the front-back direction and the lateral direction. Further, the resilient contact pieces 28 are resiliently in contact with the guide grooves 19 while being slightly resiliently deflected. Thus, collision sounds are not generated between the resilient contact pieces 28 and the holder 10 even if vibration is applied to the holder 10 and the first housing 21.

The guide edges 26 (see FIG. 8) on the holding projections 24 of the locks 23 on the first housing 21 contact the couplings 17 of the resilient locking pieces 15 of the holder 10 from below as the first housing 21 is assembled further and deflect the resilient locking pieces 15 out toward the inner surface of the peripheral wall 11. The holding projections 24 pass over the couplings 17 when the first housing 21 reaches a proper height in the holder 10, as shown in FIG. 7. Thus, the resilient locking pieces 15 resiliently return.

The locking edges 27 of the holding projections 24 are locked to the couplings 17 from above, and regulate a downward relative movement of the first housing 21 with respect to the holder 10. Simultaneously, the locking claws 18 of the resilient locking pieces 15 engage the receiving projections 25 of the first housing 21 from above to regulate an upward movement of the first housing 21 with respect to the holder 10. Thus, the first housing 21 is held assembled with the holder 10 with vertical relative movements regulated at a proper waiting position.

As shown in FIGS. 1 and 2, the second connector M is mounted on the second device 70 from above with a surface facing down toward the first connector F. The second connector M includes a second housing 40 made of synthetic resin and male second terminal fittings 52 are mounted in the second housing 40. The second housing 40 includes a second terminal holding member 41 for holding the second terminal fittings 52 and a second retainer 51 for retaining the second terminal fittings 52. The second terminal holding member 41 has a unitary housing main body 42 for holding the second terminal fittings 52 and a substantially rectangular tubular receptacle 43 surrounding a lower area of the housing main body 42. The second retainer 51 is mounted on a lower end of the second terminal holding member 41.

As shown in FIGS. 1 and 2, each of the opposite left and right side plates of the receptacle 43 has front and rear slits (see FIG. 11) extending down from the upper end thereof (end of the receptacle 43 opposite to the end facing the first connector F). Areas of the left and right side plates between the slits define second resilient lock pieces 44 in the form of long, narrow vertical plates that have lower ends supported on the side plates. A second lock 45 projects out from an upper part of each second resilient lock piece 44.

Figure 10:
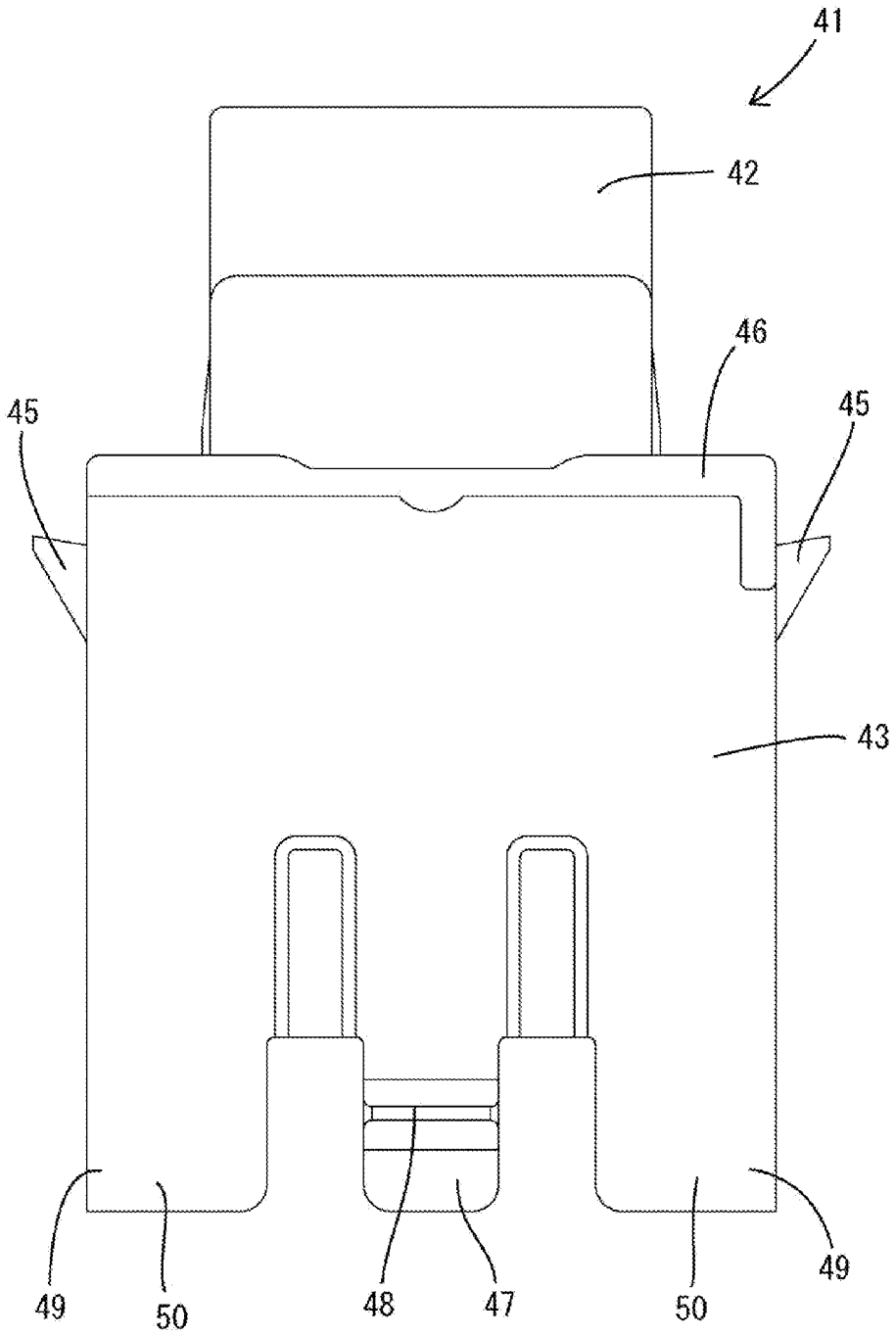
FIG. 10 is a front view of a second terminal holding member constituting a second housing.
Figure 11:
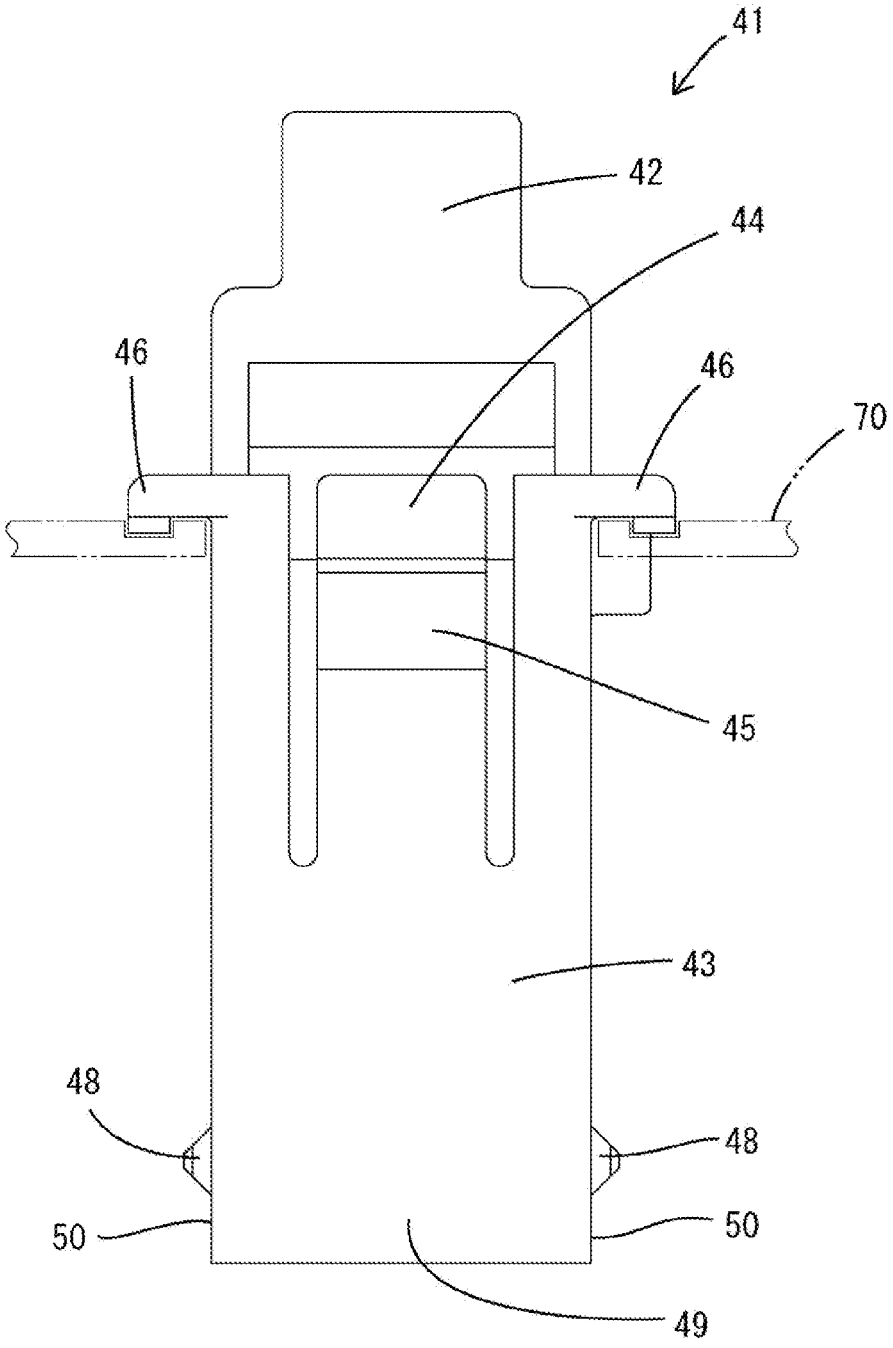
FIG. 11 is a side view of the second terminal holding member.

As shown in FIGS. 10 and 11, second locking flanges 46 project out from upper ends (positions slightly above the second locks 45) of opposite front and rear plates of the receptacle 43. With the second connector M mounted on the second device 70, the second locks 45 of the second resilient contact pieces 44 are locked to edges of the second mounting hole 71 from below, as shown in FIG. 1 and the second locking flanges 46 are locked to the edge of the second mounting hole 71 from above, as shown in FIG. 11. The second connector M is mounted on the second device 70 with vertical relative movements regulated by vertically sandwiching the edge of the second mounting hole 71 between the second locks 45 of the second resilient lock pieces 44 and the second locking flanges 46.

Figure 12:
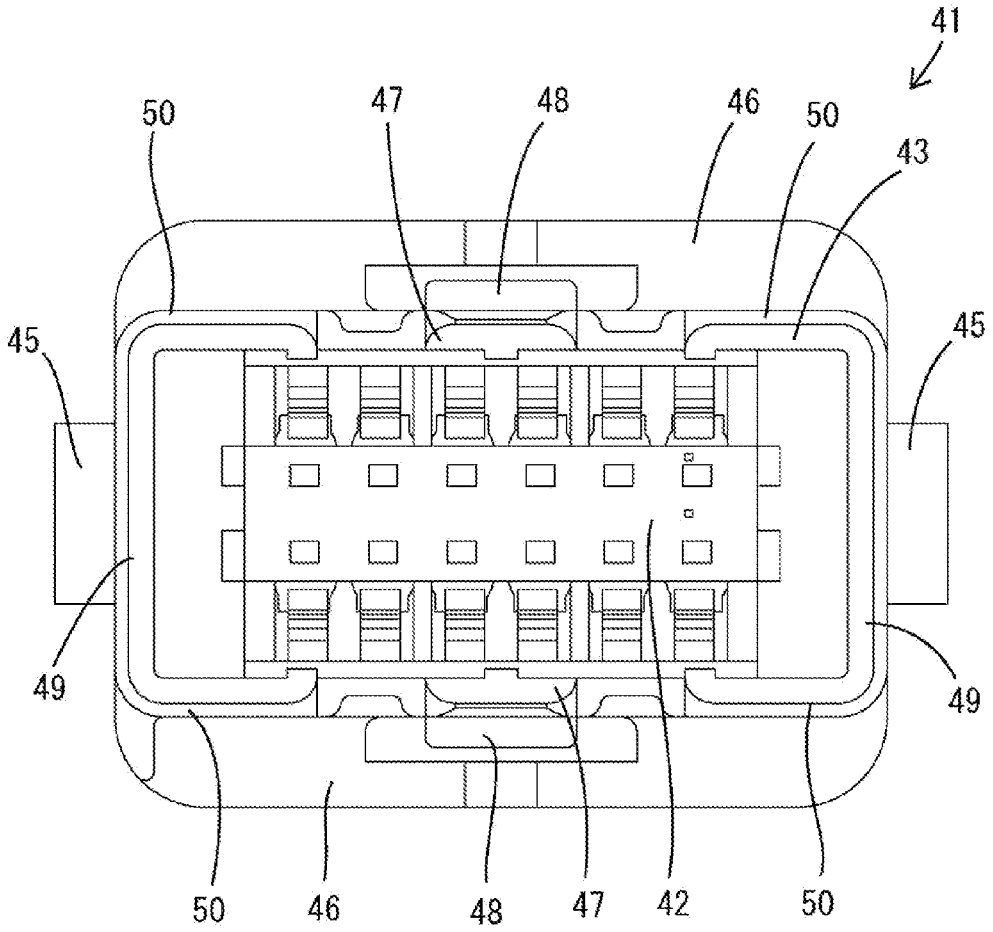
FIG. 12 is a bottom view of the second terminal holding member.

Left and right slits extend up from lower ends of the front and rear plates of the receptacle 43 (end of the receptacle 43 on a side facing the first connector F), as shown in FIGS. 10 and 12. Areas of the front and rear plates between the slits define downwardly cantilevered lock releasing portions 47 in the form of long narrow vertical plates. A releasing projection 48 in the form of a rib extends laterally at a lower position on the outer surface of the lock releasing portion 47.

Areas of the left and right side plates of the receptacle 43 below the second resilient lock pieces 44 define left and right second deflection regulating portions 49. The second deflection regulating portions 49 regulate resilient deflection of the first resilient lock pieces 12 inward in directions separating from the edge of the first mounting hole 61. Further, opposite left and right ends of a lower end part of each of the front and rear plates of the receptacle 43 define left and right pressure receiving portions 50 that regulate deflection of the resilient contact pieces 28 in directions away from the stoppers 20 (inward) when the connectors F, M are connected.

Figure 13:
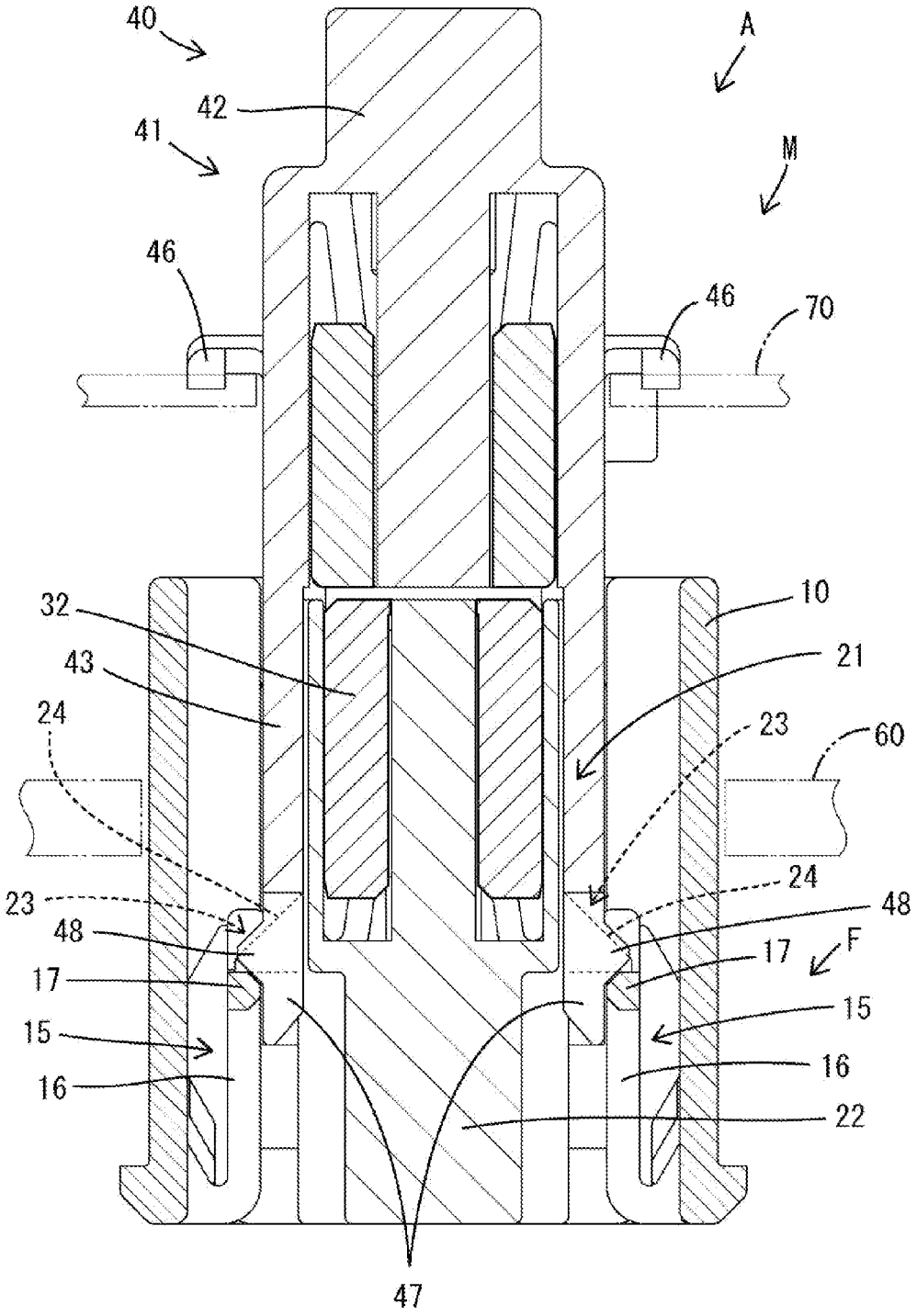
FIG. 13 is a side view in section showing a state where the resilient locking pieces and locks are locked in the process of connecting the first and second housings.

The second device 70 is assembled with the first device 60 from above so that the receptacle 43 of the second housing 40 fits into a space between the outer surface of the first housing 21 and the inner surface of the holder 10 to start the connection of the housings 21, 40. The releasing projections 48 of the lock releasing portions 47 of the second housing 40 contact the couplings 17 of the resilient locking pieces 15 of the holder 10 from above immediately before the housings 21, 40 reach a properly connected state, as shown in FIG. 13. Locking between the resilient locking pieces 15 and the locks 23 prevent relative vertical movement between the first housing 21 and the holder 10 until this state is reached, as shown in FIG. 7. Further, as shown in FIG. 14, the resilient contact pieces 28 are separated upward from the stoppers 20.

Figure 15:
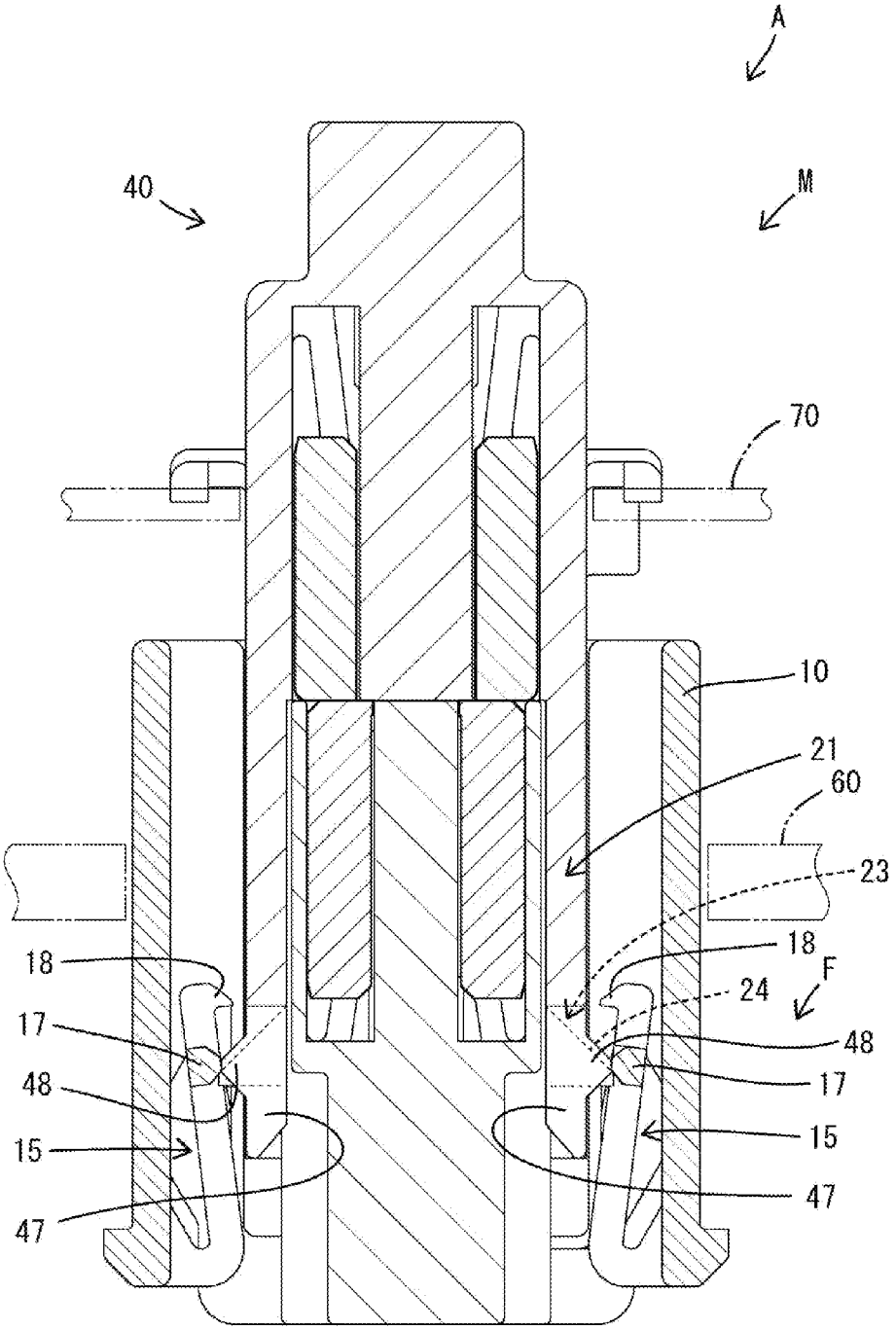
FIG. 15 is a side view in section showing a state where locking between the resilient locking pieces and the locks is released by lock releasing portions.
Figure 16:
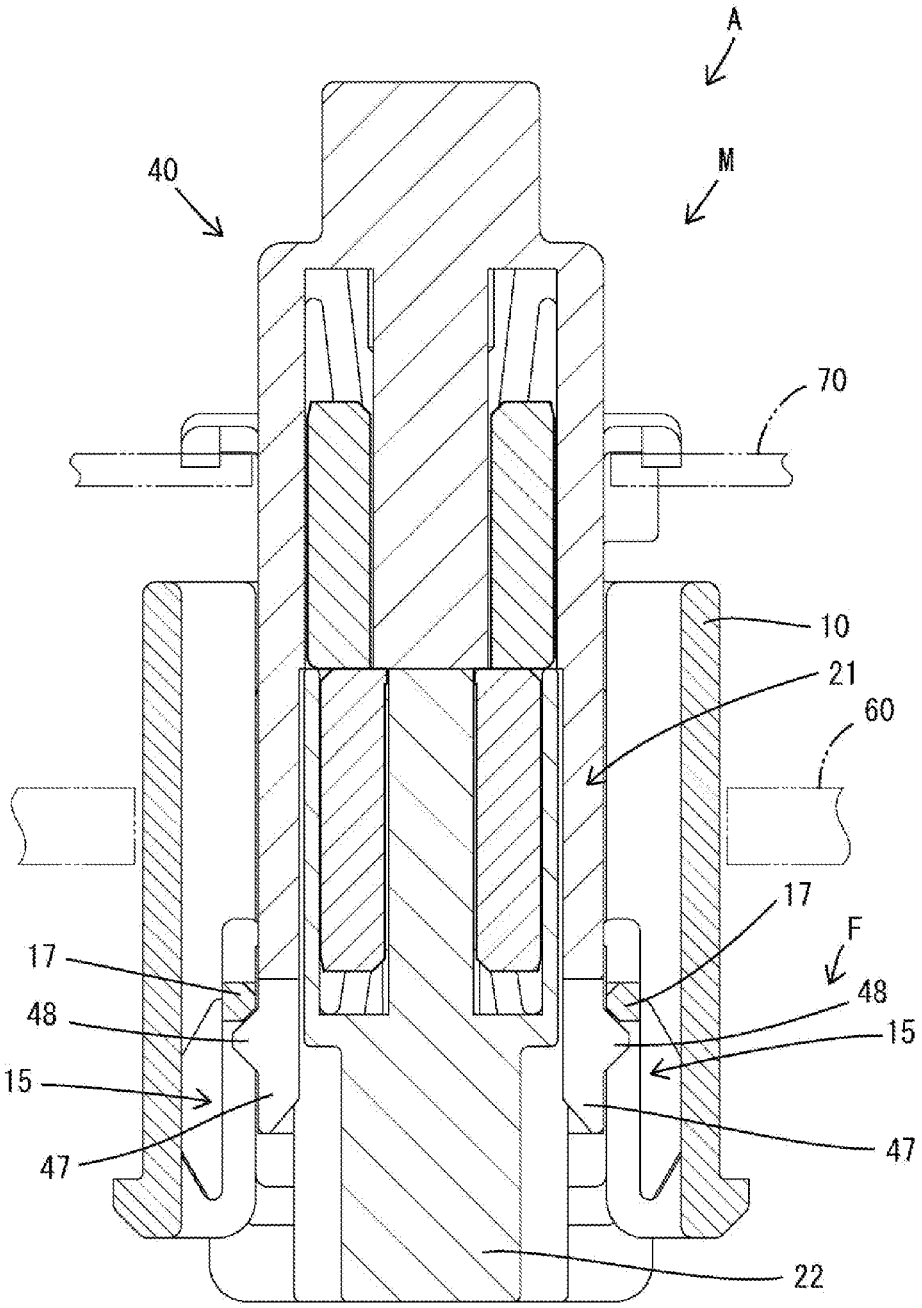
FIG. 16 is a side view in section showing a state where locking between the resilient locking pieces and the locks is released and the housings in the properly connected state are moved with respect to the holder.

As the assembling of the devices 60, 70 and the connection of the housings 21, 40 (both connectors F, M) proceeds from a state shown in FIG. 13, the releasing projections 48 press the couplings 17, as shown in FIG. 15. Thus, the resilient locking pieces 15 deflected out (forward or backward) and disengage from the locks 23. Thus, the couplings 17 of the resilient locking pieces 15 are separated from the holding projections 24 of the first housing 21. During this lock releasing operation by the lock releasing portions 47, the housings 21, 40 are connected properly and the terminal fittings 34, 52 are connected. Further, releasing the resilient locking pieces 15 from the locks 23 enables the first housing 21 to move down (direction opposite to the connecting direction to the second housing 40) with respect to the holder 10. As the assembling of the devices 60, 70 proceeds, the housings 21, 40 move down with respect to the holder 10 substantially as an integrated assembly (while maintaining the properly connected state).

Figure 17:
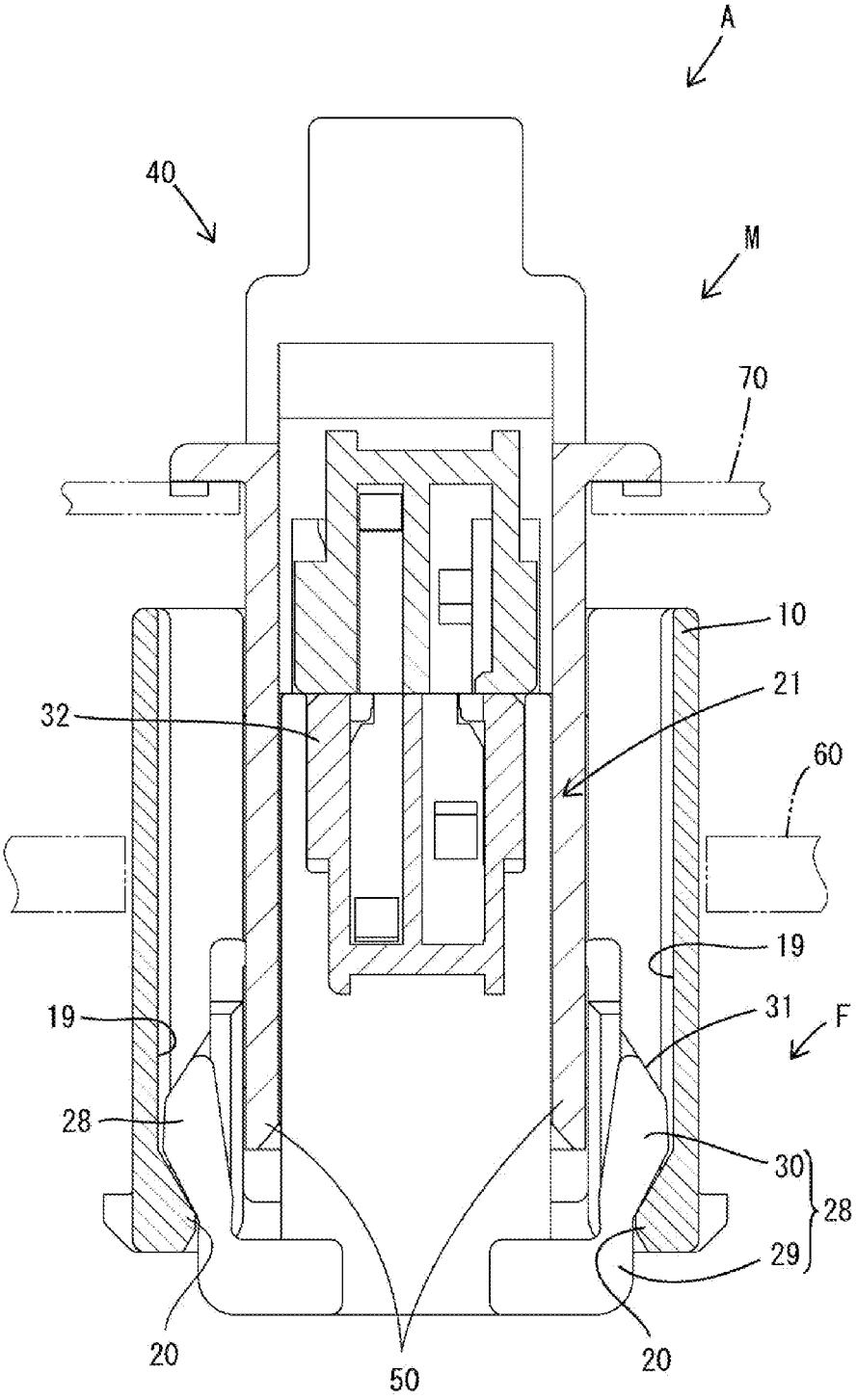
FIG. 17 is a side view in section showing a state where the properly connected housings are moved with respect to the holder and resilient contact pieces are in contact with stoppers.

A relative moving distance of the housings 21, 40 with respect to the holder 10 varies depending on an assembling tolerance of the devices 60, 70. FIG. 17 shows an example of a positional relationship of the housings 21, 40 and the holder 10 in a state where the assembling of the both devices 60, 70 is completed. In this example, the resilient contact pieces 28 are in contact with the stoppers 20 from above while being hardly resiliently deflected. If the assembling tolerance of the both devices 60, 70 differs, the height (vertical position) of the housings 21, 40 with respect to the holder 10 is higher or lower than the position shown in FIG. 17.

Figure 18:
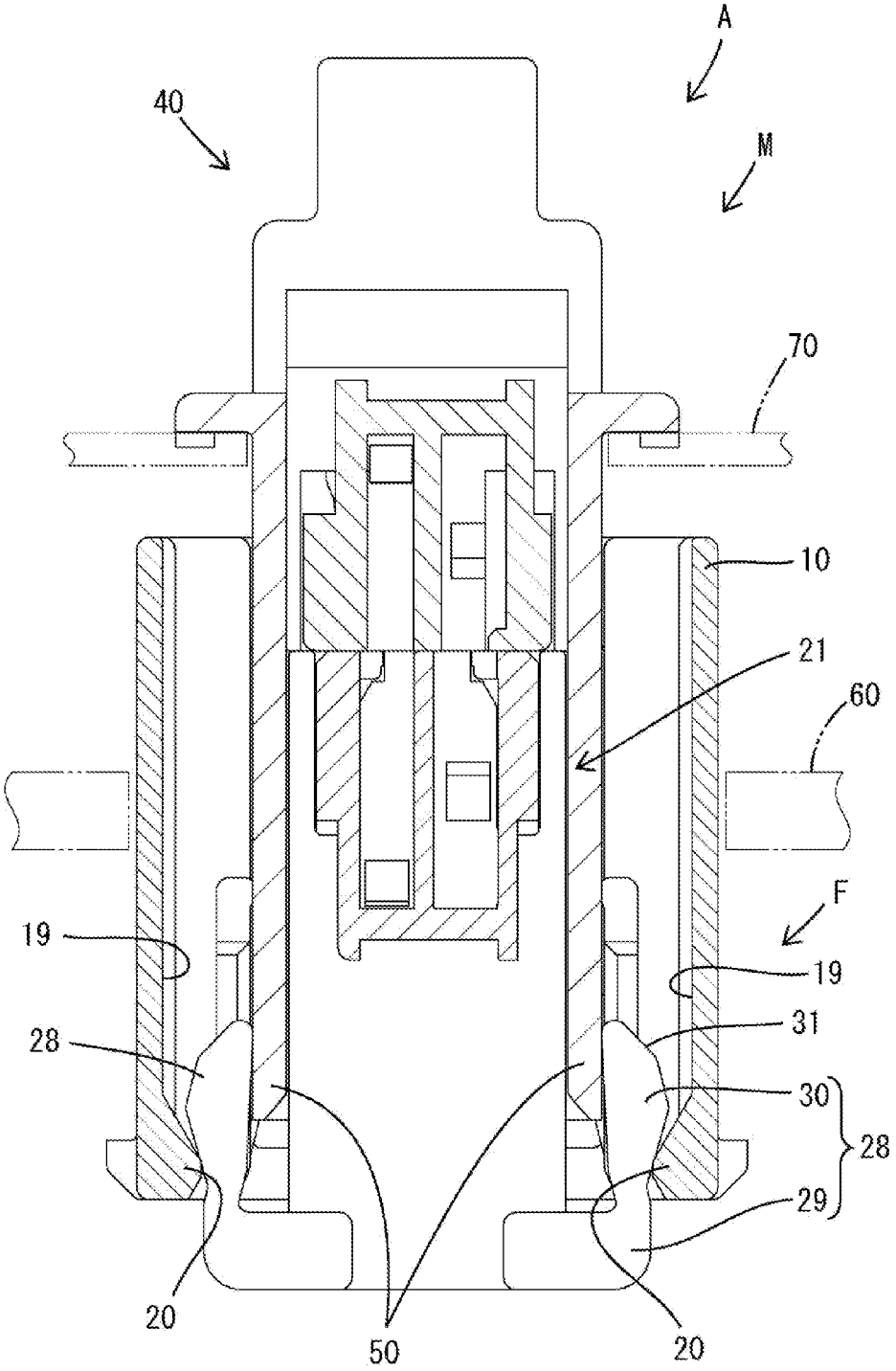
FIG. 18 is a side view in section showing a state where the properly connected housings are moved with respect to the holder and the detachment of the both housings from the holder is regulated by locking between the resilient contact pieces and the stoppers.

If the housings 21, 40 in the connected state are going to move excessively down with respect to the holder 10, the resilient contact pieces 28 are deflected in by interference with the stoppers 20, as shown in FIG. 18. If the resilient contact pieces 28 are deflected to a large extent, the resilient contact pieces 28 may pass over the stoppers 20, and the housings 21, 40 may detach down (direction opposite to the connecting direction of the first housing 21 to the second housing 40) from the holder 10. However, the resilient contact pieces 28 contact the pressure receiving portions 50 of the second housing 40 while being kept locked to the stoppers 20 to regulate or limit any further inward deflection. Thus, the housings 21, 40 are not detached down from the holder 10.

As described above, the connector A has the holder 10 to be mounted on the first device 60 so as to move integrally in an assembling direction of the first and second devices 60, 70, and the first housing 21 is movable with respect to the holder 10 substantially in the assembling direction of the second device 70 with the first device 60. The holder 10 has the resiliently deflectable resilient locking pieces 15 and the first housing 21 has the locks 23 for regulating movements of the first housing 21 with respect to the holder 10 by locking the resilient locking pieces 15.

The second housing 40 is mounted on the second device 70 to move integrally in the assembling direction of the first and second devices 60, 70 and is formed with the lock releasing portions 47. In the process of assembling the devices 60, 70, the housings 21, 40 are connected properly and the lock releasing portions 47 deflect the resilient locking pieces 15 to separate the resilient locking pieces 15 from the locks 23. The release of the locking between the resilient locking pieces 15 and the locks 23 enables the first housing 21 to move down with respect to the holder 10 while being kept properly connected to the second housing 40 as the assembling of the devices 60, 70 proceeds.

The resilient locking pieces 15 are integral with the holder 10 and the locks 23 are integral with the first housing 21 for reliably connecting the second housing 40 to the movable first housing 21 while allowing the first housing 21 to move with respect to the holder 10. Thus, a separate component is not necessary and the number of components is reduced.

The holder 10 includes the peripheral wall 11 for surrounding the first housing 21, and the resilient locking pieces 15 are formed on the holder 10 to be located inside the peripheral wall 11. Accordingly, the peripheral wall 11 protects the resilient locking pieces 15 from interference from external matter. Further, the lock releasing portions 47 receive inward reaction forces due to resilient restoring forces of the resilient locking pieces 15 when resiliently deflecting the resilient locking pieces 15 outward. However, the outer surface of the first housing 21 is in contact with or proximately facing the inner surface sides of the lock releasing portions 47. Thus, the lock releasing portions 47 hardly deflect inward. Thus, the lock releasing portions 47 can reliably deflect the resilient locking pieces 15 in directions separating from the locking portions 23.

The connector A includes the holder 10 with the peripheral wall 11 that is open on the upper side facing the second connector M and on the lower side. Thus, the first housing 21 is assembled into the peripheral wall 11 through the lower side of the holder 10 and the second housing 40 is connected to the first housing 21 through the upper side of the holder 10. The stoppers 20 are formed on the inner surface of the peripheral wall 11, the resilient contact pieces 28 are formed on the outer surface of the first housing 21 and the resilient contact pieces 28 are resiliently deflected by interference with the stoppers 20 in the process of assembling the first housing 21 into the peripheral wall 11.

The resilient contact pieces 28 are locked to the stoppers 20 in the process of assembling the first housing 21 into the peripheral wall 11 and connecting the first housings 21 to the second housing 40, thereby impeding detachment of the first housing 21 from the peripheral wall 11 toward the lower side. Accordingly, detachment of the first housing 21 from the holder 10 toward the lower side is impeded by a connecting force with the second housing 40 while the assembling of the first housing 21 into the peripheral wall 11 through the lower side of the holder 10. That is, the first connector F is not separated.

The resilient contact pieces 28 are in contact with the outer surface (pressure receiving portions 50) of the second housing 40 when the housings 21, 40 are connected to impede separation from the stoppers 20. Accordingly, the first housing 21 will not detach from the holder 10. Further, the resilient contact pieces 28 to slide in contact with the guide grooves 19 of the peripheral wall 11 for guiding the movement of first housing 21. Accordingly, the engagement of the resilient contact pieces 28 and the guide grooves 19 prevents relative movement of the first housing 21 with respect to the holder 10 in directions intersecting a moving direction. Further, the resilient contact pieces 28 slide in contact with the guide grooves 19 while being resiliently deflected. Thus, there is no abnormal noise due to the contact and separation of the resilient contact pieces 28 and the guide grooves 19.

A mounting structure of the first device 60 formed with the first mounting hole 61 and the first connector F to be mounted in the first mounting hole 61 is described in this embodiment. In this mounting structure, the first resilient lock pieces 12 to be resiliently deflected by interfering with the edge of the first mounting hole 61 in the process of mounting the first connector F into the first mounting hole 61 are formed on the outer surface of the first connector F. Further, the first locking projections 14 are formed on the outer surface of the first connector F for holding the first connector F mounted in the first mounting hole 61 by sandwiching the edge of the first mounting hole 61 between the first resilient lock pieces 12 and the first locking projections 14.

The second connector M is formed with the second deflection regulating portions 49 for preventing deflection of the first resilient lock pieces 12 away from the edge of the first mounting hole 61 when the second connector M is connected to the first connector F. Accordingly, the edge of the first mounting hole 61 is held sandwiched between the first resilient lock pieces 12 and the first locking projections 14 when the first and second connectors F, M are connected. Thus, the first connector F is mounted reliably in the first mounting hole 61 of the first device 60.

The first connector F has the peripheral wall 11 with the first resilient lock pieces 12, and the block-like first housing 21 is accommodated in the peripheral wall 11. The second connector M has the receptacle 43 to be accommodated between the inner surface of the peripheral wall 11 and the outer surface of the first housing 21 and the receptacle 43 functions as the first deflection regulating portion 33. Thus, the receptacle 43 additionally functions as the first deflection regulating portion 33 so that the shape of the second connector M can be simplified as compared with the case where dedicated deflection regulating portions are separate from the receptacle 43.

Similarly, a mounting structure of the second device 70 formed with the second mounting hole 71 and the second connector M to be mounted in the second mounting hole 71 is described above. The second resilient lock pieces 44 are formed on the outer surface of the second connector M and resiliently deflect by interfering with the edge of the second mounting hole 71 when mounting the second connector M in the second mounting hole 71. Further, the second locking projections 46 are formed on the outer surface of the second connector M to hold the second connector M in the second mounting hole 71 by sandwiching the edge of the second mounting hole 71 between the second resilient lock pieces 44 and the second locking projections 46.

The first connector F connectable to the second connector M is formed with the first deflection regulating portions 33 for regulating resilient deflection of the second resilient lock pieces 44 in the directions separating from the edge of the second mounting hole 71 with the first connector F connected to the second connector M. Accordingly, when the first and second connectors F, M are connected, the state where the edge of the second mounting hole 71 is sandwiched between the second resilient lock pieces 44 and the second locking projections 46 is maintained. Thus, the second connector M is mounted reliably in the second mounting hole 71.

The second connector M may include the receptacle 43 formed with the second resilient lock pieces 44, the first connector F may include the first housing 21 surrounded by the peripheral wall 11 and to be accommodated into the receptacle 43 and the first housing 21 may function as the first deflection regulating portions 33. According to this configuration, since the first housing 21 additionally has a function as the first deflection regulating portions 33, the shape of the first connector F can be simplified as compared with the case where dedicated deflection regulating portions are formed separately from the first housing 21.

The invention is not limited to the above described and illustrated embodiment. For example, the following embodiments also are included in the scope of the invention.

The receptacle of the second connector additionally has a function as the deflection regulating portions in the above embodiment. However, the second connector may be formed with dedicated deflection regulating portions separately from the receptacle.

Although the outer surface of the first housing additionally has a function as the deflection regulating portions in the above embodiment, the first connector may be formed with dedicated deflection regulating portions separately from the outer surface of the first housing.

The first connector includes the resilient lock pieces and the deflection regulating portions and functions as a device-side connector and the mating connector in the above embodiment. However, the first connector may function only as the mating connector without including the resilient lock pieces or may function only as the device-side connector without including the deflection regulating portions.

The second connector includes the resilient lock pieces and the deflection regulating portions and functions as the device-side connector and the mating connector in the above embodiment. However, the second connector may function only as the mating connector without including the resilient lock pieces or may function only as the device-side connector without including the deflection regulating portions.

LIST OF REFERENCE SIGNS

A connector
F first connector (device-side connector, mating connector)
M second connector (device-side connector, mating connector)
11 peripheral wall
12 first resilient lock piece (resilient lock piece)
14 first locking projection (locking projection)
21 first housing (device-side housing, mating housing)
33 first deflection regulating portion (deflection regulating portion)
43 receptacle
44 second resilient lock piece (resilient lock piece)
46 second locking projection (locking projection)
49 second deflection regulating portion (deflection regulating portion)
60 first device (device)
61 first mounting hole (mounting hole)
70 second device (device)
71 second mounting hole (mounting hole)

What is claimed is:

1. A connector mounting structure, comprising:
a device (60) formed with a mounting hole;
a device-side connector to be mounted in the mounting hole;
a resilient lock piece formed on an outer surface of the device-side connector and configured to be resiliently deflected by interfering with an edge of the mounting hole in the process of mounting the device-side connector into the mounting hole;
a locking projection formed on the outer surface of the device-side connector and configured to hold the device-side connector in the mounting hole by sandwiching the edge of the mounting hole (61) between the resilient lock piece and the locking projection;
a mating connector connectable to the device-side connector; and
a deflection regulating portion formed on the mating connector and configured to regulate resilient deflection of the resilient lock piece in a direction separating from the edge of the mounting hole with the mating connector connected to the device-side connector.

2. The connector mounting structure of claim 1, wherein:
the device-side connector includes a peripheral wall formed with the resilient lock piece and a block-like device-side housing accommodated in the peripheral wall;
the mating connector includes a receptacle to be accommodated between an inner surface of the peripheral wall and an outer surface of the device-side housing; and
the receptacle functions as the deflection regulating portion.

3. The connector mounting structure of claim 1, wherein:
the device-side connector includes a receptacle formed with the resilient lock piece;
the mating connector includes a mating housing surrounded by a peripheral wall and to be accommodated into the receptacle; and
an outer surface of the mating housing functions as the deflection regulating portion.

* * * * *